United States Patent [19]

Bergermann et al.

[11] Patent Number: 4,504,825

[45] Date of Patent: Mar. 12, 1985

[54] METHOD OF DISPLAYING A TEXT ON A SINGLE-LINE DISPLAY UNIT OF A WORD PROCESSOR

[75] Inventors: Franz Bergermann, Fürth; Michael Prüfer, Cadolzburg, both of Fed. Rep. of Germany

[73] Assignee: Triumph-Adler A.G. fur Buro und Informationstechnik, Nuremberg, Fed. Rep. of Germany

[21] Appl. No.: 437,902

[22] Filed: Nov. 1, 1982

[30] Foreign Application Priority Data

Mar. 13, 1982 [DE] Fed. Rep. of Germany ..... 3209187

[51] Int. Cl.[3] ..... G09G 3/00

[52] U.S. Cl. ..... 340/709; 340/792; 364/523; 400/63; 400/83

[58] Field of Search ..... 340/709, 724, 792; 364/523; 400/279, 280, 63, 83

[56] References Cited

U.S. PATENT DOCUMENTS 3,618,032 11/1971 Goldsberry et al. .
3,654,609 4/1972 Bluethman et al. .
4,360,806 11/1982 von Knorre et al. ..... 340/792
4,389,641 6/1983 Nakanishi et al. ..... 340/792
4,408,302 10/1983 Fessel et al. ..... 400/83
4,439,838 3/1984 Klingenberg ..... 400/83

*Primary Examiner*—Gerald L. Brigance
*Attorney, Agent, or Firm*—Joseph R. Spalla

[57] ABSTRACT

Information stored in a working memory of a word processor comprising symbols representing alphanumeric text characters and word processor functions are displayed by means of a line display unit with alphanumeric text characters and function symbols each occupying only one display position on the line display unit.

When the meaning of a function symbol identified by a cursor positionable to identify the next display position to be processed is not evident, its meaning is automatically displayed in leftmost positions of the display unit, with suppression or shift of the text already displayed in said leftmost positions taking place as necessary to display the meaning of a function symbol.

3 Claims, 8 Drawing Figures

Automatische Bedienerführung
Fig_2
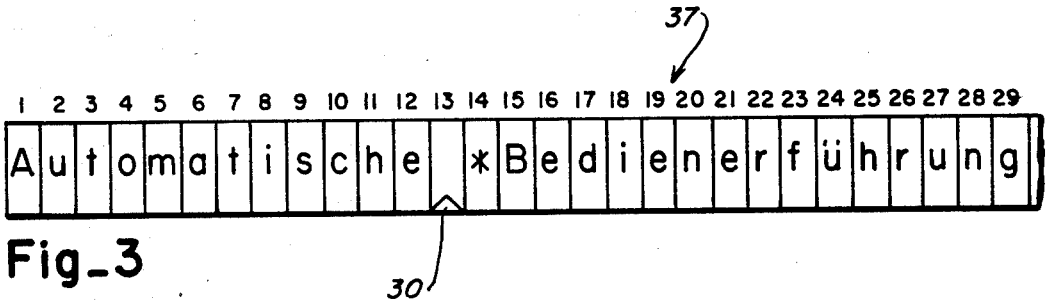
Fig_3
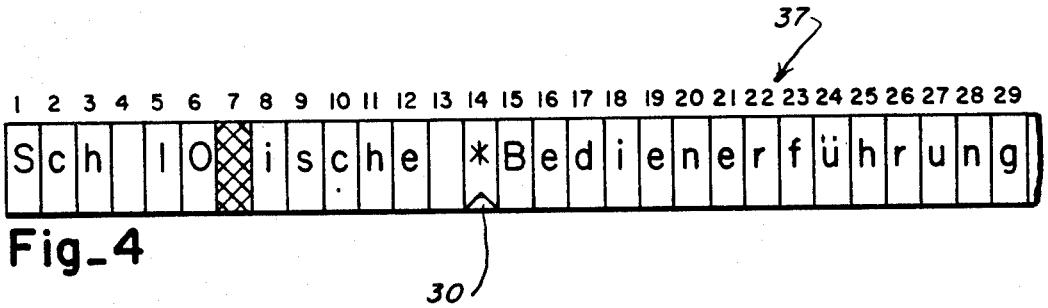
Fig_4
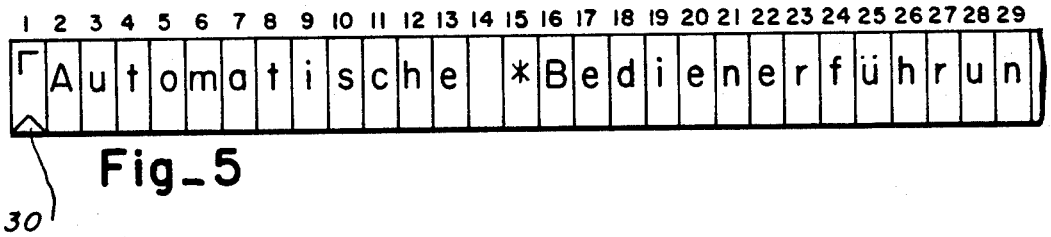
Fig_5
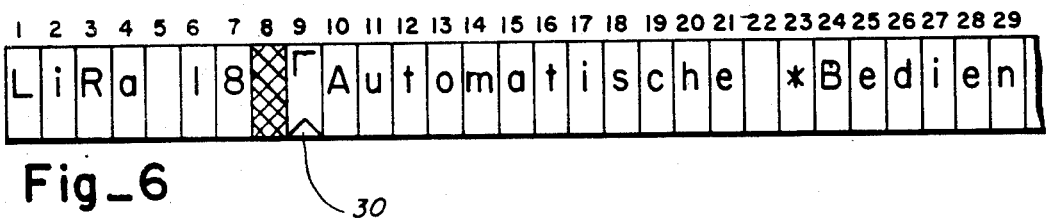
Fig_6

METHOD OF DISPLAYING A TEXT ON A SINGLE-LINE DISPLAY UNIT OF A WORD PROCESSOR

The invention relates to a method of displaying text characters and word processor function symbols stored in a working memory of a word processor on a line display unit having a predetermined number a display positions identified for processing by a cursor; more particularly it relates to a method of displaying the meaning of a function symbol in the text when the cursor is positioned at the position displaying the function symbol; and specifically to a method for displaying the meaning of a function symbol identified by a cursor in leftmost positions of the display with suppression or shift of text in the leftmost positions taking place to accommodate display of the function symbol meaning.

It is common practice in word processors, particularly those for composing and processing texts, to display the passage to be processed of a text stored in a working memory on a line display unit comprising a multiplicity of display positions and to identify the character actually to be processed by a mark designated a cursor. The information stored in the working memory of the word processor contains all of the alpha-numeric characters of the text and the functions to be performed by the word processor at certain points in the text. These functions are shown on the display unit in the form of function symbols. Today's text composing and processing machines contain so many functions that the display of their meaning oftentimes requires more than a single display space. Furthermore, for certain functions such as changing the margin settings or changing the typing pitch, it is necessary to show, in addition to the function symbols, several alpha-numeric characters in order to provide the operator with complete information on the appearance of the text.

Experiments have shown that the clarity of a text displayed on the display unit is greatly reduced if function symbols occupying several display spaces or combinations of function symbols and alpha-numerical characters are displayed within displayed alpha-numeric text. Beyond this, the extent of the display spaced available for the display of text is greatly restricted by this function information.

The display of a text stored in a working memory of a word processor on a line display unit is described in British Patent Application GB No. 20 44 969 A wherein provision is made for displaying to an operator function information on the right part of a two-part display unit, while the left part is used to display the text. This entails the disadvantage that the right part of the display unit reserved for function information cannot be utilized to display text.

It is not evident from said Patent Application GB No. 20 44 969A how functions to be performed by the word processor in the course of reproducing or processing a text stored in the working memory, are displayed in the text visible on the display unit, or how more detailed explanations of the meaning of such functions can be displayed.

In accordance with the invention, word processor functions are each represented by a discrete function symbol occupying a single display space or position within the text displayed in a line display. If the cursor is positioned at the display position at which a function symbol resides, and it is determined that it is one which requires explanation, a display control unit is made operative to erase or suppress the characters displayed in a number of predetermined display spaces as required to display the function symbol meaning stored in a auxiliary memory, or if the function symbol requiring explanation is at a first display position, the display control is operative to shift the display to provide room for displaying the meaning of the function symbol.

An object of the invention, therefore, is to provide a method which permits the utilization of substantially all display positions on a line display unit contained in a word processor for the display of the text, and at the same time, to convey to the operator for the word processor, as needed and while maintaining the clarity of the displayed text, complete information on the appearance of the text.

Another object of the invention is in the provision of a method whereby explanations to the operator of the meaning of a function symbol occupying only a single space within the text but requiring several display spaces can be shown on the single-line display unit of a word processor automatically only wnen a function symbol requiring explanation is identified whereby the total number of display spaces can otherwise be made available for the display of text characters and function symbols each occupying only a single display space.

Another object of the invention is to provide a method which makes it possible to display in an advantageous manner, the meaning of a function symbol within the text requiring explanation to an operator always at the same location of the display unit as needed so that that part of the display is preserved for displaying text.

Other objects, features, and advantages of the present invention will become better known to those skilled in the art from a reading of the following detailed description when taken in conjunction with the accompanying drawing wherein like reference numerals designate like or corresponding elements throughout the several views thereof and wherein;

FIG. 2 is a view showing a text stored in the working memory of a word processor;

FIGS. 3 to 6 are views illustrating the text displayed on a single line display unit of the word processing system, and FIGS. 7 and 8 comprise a logical flow diagram.

Figure 1:
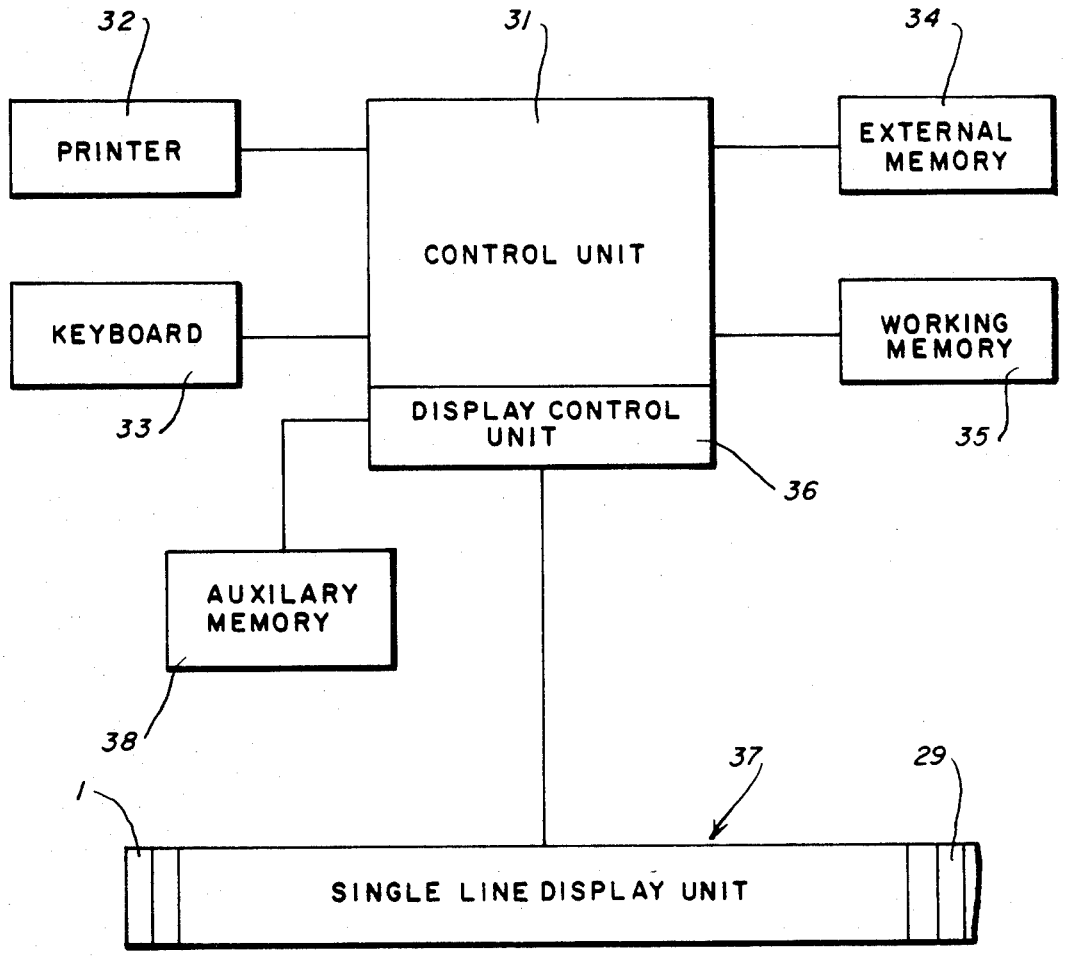
FIG. 1 is a block circuit diagram of elements of a word processing system.

Referring now to FIG. 1, there is shown a word processor having the capability of composing and processing texts. The word processor comprises a control unit 31 to which is connected a printer 32, a keyboard 33, an external memory 34, a working memory 35 and, via a display control unit 36, which may be part of control unit 31, a line display unit 37 comprising a multiplicity of display positions 1 to 29. Also, an auxiliary memory 38 is connected to the display control unit 36.

In the following description of the method of displaying a text on a single-line display unit of a word processor of the type described above, it is assumed that a text, entered via the keyboard 33 and stored in the working memory 35, is to be displayed on the display unit 37 and reproduced by means of the printer 32.

FIG. 2 shows the text "Automatische Bedienerführung" as stored in the working memory 35 in the form it is to appear on paper after reproduction. As is easy to see, a different pitch was chosen for the word "Automatische" than for the word "Bedienerführung". The pitch change from e.g. 1/15" for the word "Automatische" to 1/10" for the word "Bedienerfuhrüng" will have been entered when the text was put in and stored as a function symbol in the working memory 35 of the word processor. when displaying the text in working memory 35 on the display unit 37, the pitch change function symbol will be displayed as shown in FIG. 3 in the form of an asterisk in display position 14, i.e. at the point of the text where the change is to take place. With the cursor 30 at position 1 reproduction commences on reproduce command. After the sequential reproduction of characters 1 to 12 the movable cursor 30 will be at the display position 13, and after the reproduction of the character space indicated there, the cursor 30 will move to display position 14 under the asterisk function symbol, as shown in FIG. 4. On this occurrence the display control unit will cause the characters "Automat" (see FIG. 3) shown in the display spaces 1 to 7 to be erased or suppressed from the display unit and the characters "Sch 10⊠" (meaning 10 pitch) to be displayed instead. The symbol "Sch" is an abbreviation of the German Schritt meaning escapement pitch. The symbol ⊠ shown in the display space 7 represents the separating line between the explanation or meaning of the function symbol appearing in the display spaces 1 to 6, and the actual text.

After displaying the meaning of the word processor function represented by the asterisk function symbol in display spaces 1 to 6, the cursor 30 moves to display position 15 with the result that the function symbol meaning "Sch 10⊠" displayed in display positions 1 to 7 erased from the display 37, and the original text as shown FIG. 3 reappears in display positions 1 to 7 of the display unit 37.

It is apparent from FIGS. 3 and 4 that a function symbol occuring in the text displayed in one of the leftmost positions, where the meaning thereof is to be shown, would be erased by the display of its meaning, whereby the connection between function symbol and its meaning would be lost. To overcome this situation a special display unit control, explained below in greater detail with reference to FIGS. 5 and 6 is provided wherein it is assumed that, prior to putting the text shown in FIG. 2 into working memory 35, a left margin setting, e.g. eighteen spaces, is stored in the working memory 35 as the first information, followed by the text of FIG. 2.

Accordingly, with reference to FIG. 5 when reproducing the content of the working memory 35, a function symbol taking the form of an angle "Γ", representing the left margin setting appears in display position 1 while the rest of the text of FIG. 2 is displayed in the display position 2 to 29. The function symbol Γ shown in the display position 1 is one requiring an explanation as to the left margin setting. Accordingly when display position 1 is identified by the cursor 30 for processing, an appropriate explanation reading "LiRa 18⊠" according to the example must be shown in the display spaces 1 to 8. But due to the direct display of the explanation the function symbol shown in the display space 1 would be erased, thus rendering processing of this text passage much more difficult. To avoid this the text, as illustrated in FIG. 6, under control of the display control unit 36 is first shifted to the right by eight display positions so that the left margin function symbol identified for processing by the cursor 30 appears in display position 9. As shown in FIG. 6, the display of the explanation "LiRa 18⊠" then appears in the freed display positions 1 to 8. As soon as the meaning of the function symbol identified for processing by the cursor 30 has been reproduced the cursor moves to display position 10. This effects erasure of the explanation in the display spaces 1 to 8 and shifting of the text to the left by eight display positions so that the function symbol representing the left margin setting reappears in the display space 1 as shown in FIG. 5.

The above described display of the text on the display unit of the word processor as noted is controlled by means of the display control unit 36. To illustrate the method according to the invention, the control cycle will be explained below by means of a flow diagram without detailing, however, how the text information to be displayed is made available to the display control unit 36 and how the display unit 37 is driven on the physical plane, because this does not form part of the scope of the method according to the invention.

To better understand the control cycle, some notes regarding the display of the alpha-numeric characters, function symbols and explanations relating to certain function symbols are in order. As already noted in connection with FIG. 1, the display control unit 36 is connected to an auxiliary memory 38. This auxiliary memory 38 contains the alpha-numeric characters, function symbols, and explanations, or meanings, of the function symbols in the form required to drive the display unit 37. The data stored in the auxiliary memory 38 are addressed by the characters and function information made available to the display control unit 36 by the working memory 35. For explanations of function symbols containing parameters such as pitch, margin positions, etc., the respective information displayed on the display unit 37 is combined by means of the display control unit 36, the parameters being taken from the text information made available to display control unit 36 and transformed into displayable data, while the explanation is recalled from the auxiliary memory 38 directly by appropriate addressing.

In the following description of the control cycle it is assumed that the text stored in coded form in the working memory 35 of the word processor is available to the display control unit 36 completely or partly, depending on its size, and is displayed by it on the display unit 37. It is assumed further that the text displayed is to be reproduced character serially, the character next to be reproduced being designated by the cursor 30 generated by the display control unit 36 on the display unit 37.

Figure 7:
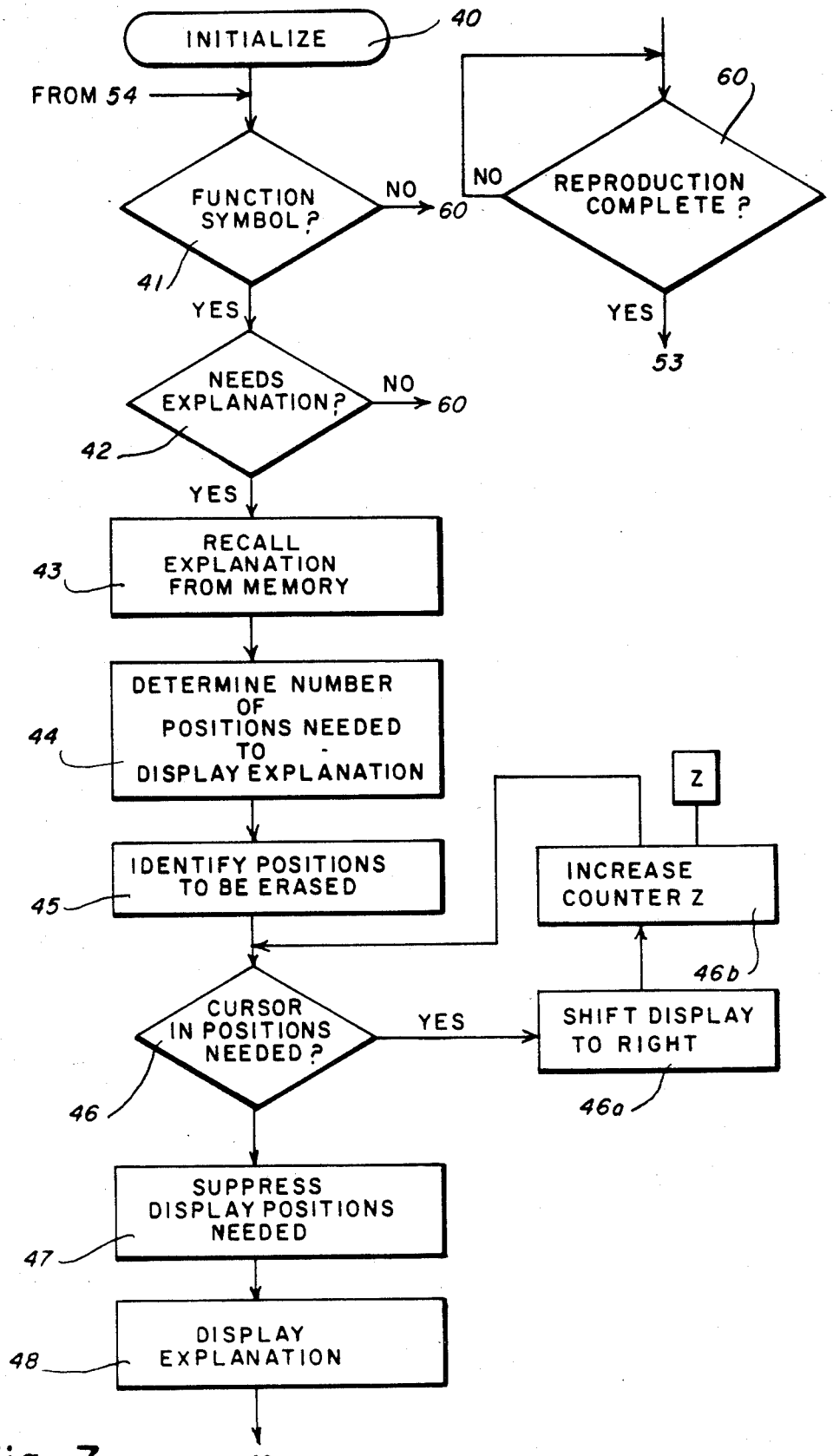
Figure 8:
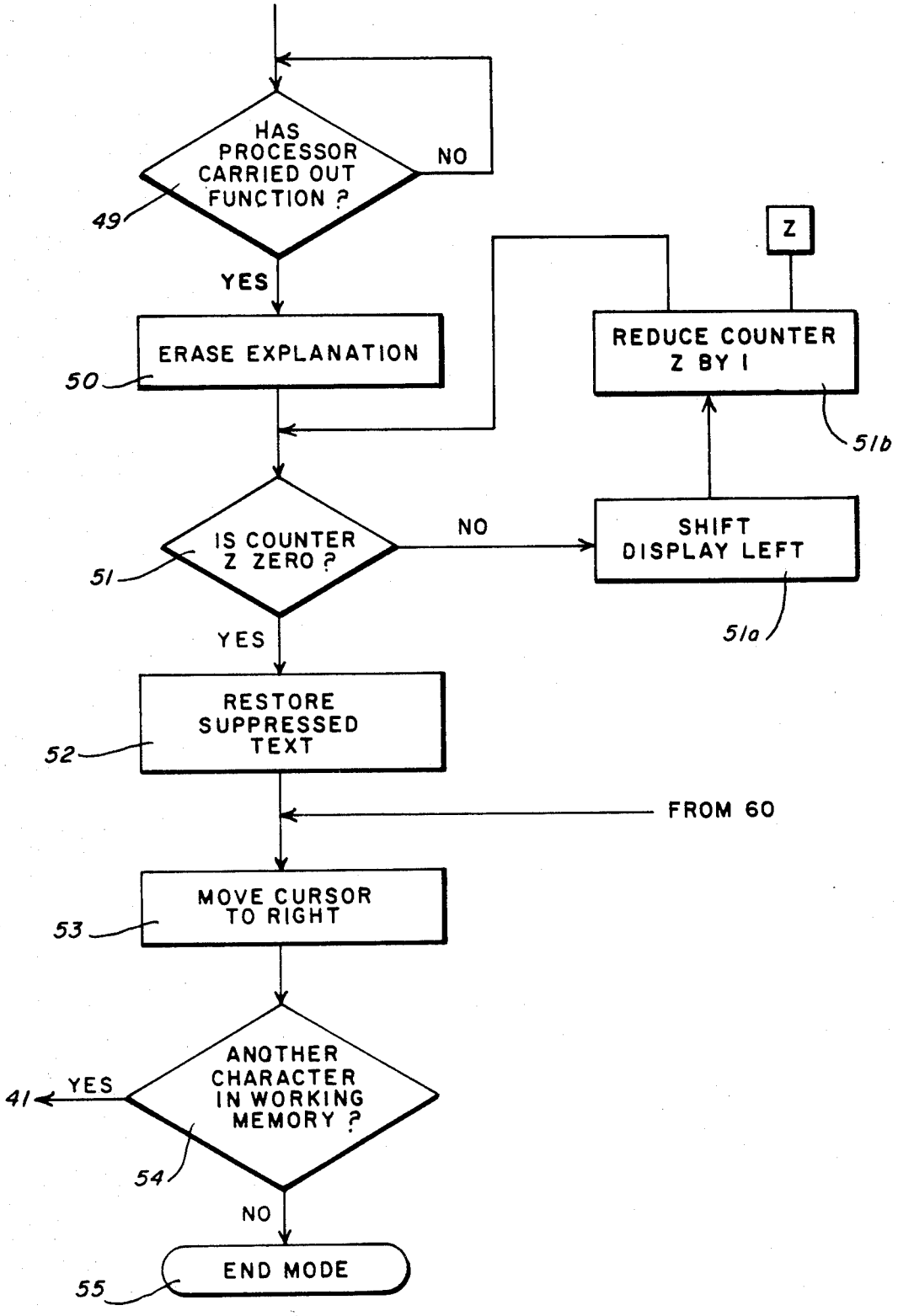

With reference to FIGS. 7 and 8 a flow diagram of the control cycle for the automatic display of explanations of function symbols is shown. The diamonds and rectangles therein, representing the various steps of the control cycle on the uppermost logic plane, themselves represent subordinate control stages, all of which are known to those skilled in art, however, so that no detailed discussion is needed. For better clarity, the flow diagram is described in chart form.

Step 40 Initialization of the operating mode "reproduce character serially" by keyboard actuation. Continuation with step 41.

Step 41 Interrogation whether the character designated by the cursor involves a function symbol. In the negative, continuation with step 60; in the affirmative, with step 42.

Step 42 Interrogation whether the function symbol is one requiring an explanation. If no, continuation with step 60; if yes, with step 43.

Step 43 Recall of the function symbol explanation from the memories and their combination by the display control unit 36, if necessary. Continuation with step 44.

Step 44 Determination of the number of display positions required to display the explanation. Continuation with step 45.

Step 45 Identification of the display positions to be erased. Continuation with step 46.

Step 46 Interrogation whether the cursor is displayed at one of the display positions identified in step 45. If yes, continuation with step 46*a;* if no, with step 47.

Step 46*a* The entire text displayed on the display unit is shifted to the right by one position. Continuation with step 46*b*.

Step 46*b* The count of counter Z is increased by one unit. Continuation with step 47.

Step 47 Erasure of the display positions identified in step 45. Continuation with step 48.

Step 48 The explanation generated in step 43 is displayed in the erased display positions. Continuation with step 49.

Step 49 Interrogation whether the information represented by the function symbol has been carried out by the word processor. If no, continuation with step 49; if yes, with step 50.

Step 50 Erasure of the explanation displayed in the display positions identified in step 45. Continuation with step 51.

Step 51 Interrogation whether the count of counter Z is zero. If no, continuation with step 51*a;* if yes, with step 52.

Step 51*a* The entire text displayed on the display unit is shifted to the left by one display position. Continuation with step 51*b*.

Step 51*b* The count of counter Z is reduced by one unit. Continuation with step 52.

Step 52 The text is again displayed on the display unit the way it was prior to step 46. Continuation with step 53.

Step 53 The display control unit 36 (FIG. 1) moves the cursor to the right by one display position. Continuation with step 54.

Step 54 Interrogation whether another character is yet to be reproduced. If no, continuation with Step 55; if yes, with step 41.

Step 55 Cancellation of the operating mode "reproduce character serial".

Step 60 Interrogation whether the reproduction of the character identified by the cursor 30 is complete. If no, continuation with step 60; if yes, with step 53.

Of course, the control cycle described above is to be understood as one embodiment of the method according to the invention. Instead of the control steps 46*a* and 46*b* in particular, an alternate solution is to shift the text in the display unit to the right by the number of spaces determined in control step 44 and continue the control cycle with step 48. Correspondingly, in this solution, the steps 51, 51*a*, and 51*b* would be replaced by a shift of the text displayed on the display unit 37 to the left by the number of display spaces determined in control step 44. It should be noted regarding the shifting operation of the text displayed on the display unit 37 that the characters no longer displayable on the display unit 37 when the text is shifted to the right are suppressed, of course, and are displayed again when the text is shifted back to the left.

As is evident from the above, the method according to the invention provides the possibility of automatically displaying all information on the text to be processed which the word processor operator needs whenever he actually requires it so that the display capacity of the display unit is not unnecessarily restricted.

It should yet be noted in closing that, naturally, in addition to the functions described in the examples (change of pitch, change of the left margin), the explicit meaning of all imaginable functions of a word processor can be displayed with the help of the method according to the invention. Accordingly, the invention is not limited to the examples chosen to illustrate the invention.

The invention claimed is:

1. In a word processor having a working memory for storing symbols representing text characters and word processor functions, a multi-position line display unit, a display control unit to effect the display of text stored in said working memory on said display unit and the display of a cursor to identify the display position to be processed, and an auxiliary memory for storing symbols representing the meaning of said function symbols which require explanation, a method for displaying the meaning of function symbols comprising the steps of, displaying said symbols representing text characters and word processor functions in respective single display positions on said line display unit, determining if the current display position identified by said cursor displays a function symbol, determining if an identified function symbol is one of those function symbols which requires explanation, operating the display control unit to suppress the symbols displayed in a number of display positions sufficient to display the meaning of the cursor identified function symbol requiring explanation, and displaying instead the stored symbols representing the meaning of the function symbol in said suppressed display positions.

2. A method according to claim 1, wherein the suppressed display positions always occupy positions starting with the first display position at the left margin of the display unit.

3. A method according to claim 2, further including the steps of determining if the function symbol identified by the cursor and requiring explanation is displayed in one of the display positions to be suppressed, and shifting the display to the right prior to suppression when the function symbol is in a position to be suppressed so that said function symbol appears in the first display space next following the display positions to be suppressed.

* * * * *